US006474496B1

(12) United States Patent
Garton

(10) Patent No.: US 6,474,496 B1
(45) Date of Patent: Nov. 5, 2002

(54) CONTAINMENT TANK ASSEMBLY

(75) Inventor: Darwin Garton, Malcolm, NE (US)

(73) Assignee: Snyder Industries, Inc.

( * ) Notice: Subject to any disclaimer, the term of this patent is extended or adjusted under 35 U.S.C. 154(b) by 0 days.

(21) Appl. No.: 09/519,323

(22) Filed: Mar. 6, 2000

(51) Int. Cl.[7] ..... B65D 6/00
(52) U.S. Cl. ..... 220/565; 220/567.2; 220/4.12
(58) Field of Search ..... 220/565, 567.2, 220/4.12

(56) References Cited

U.S. PATENT DOCUMENTS

| | | | | |
|---|---|---|---|---|
| 665,349 | A | | 1/1901 | Sewall |
| 963,454 | A | | 7/1910 | Meinecke |
| 1,330,868 | A | | 2/1920 | Harrison |
| 1,520,230 | A | | 12/1924 | Flath |
| 1,544,024 | A | | 6/1925 | Moeller et al. |
| 1,551,007 | A | | 8/1925 | Bruns |
| 1,970,940 | A | | 8/1934 | Laube |
| 1,983,118 | A | | 12/1934 | Bourque |
| 2,043,045 | A | | 6/1936 | Krinard |
| 2,295,514 | A | * | 9/1942 | Brinkman ..... 220/565 |
| 2,378,126 | A | * | 6/1945 | Blair ..... 220/565 |
| 2,637,459 | A | | 5/1953 | Jordan |
| 2,777,295 | A | | 1/1957 | Bliss et al. |
| 3,125,388 | A | | 3/1964 | Costantini et al. |
| 3,304,852 | A | | 2/1967 | Lande |
| 3,338,010 | A | | 8/1967 | Waugh |
| 3,352,443 | A | | 11/1967 | Sattelberg et al. |
| 3,383,004 | A | | 5/1968 | Closner |
| 3,473,689 | A | | 10/1969 | Hutter |
| 3,760,972 | A | | 9/1973 | McKirnan |
| 3,930,590 | A | | 1/1976 | Ebbrell |
| 4,425,743 | A | | 1/1984 | Bartur |
| 4,513,550 | A | | 4/1985 | Kotcharian |
| 4,519,415 | A | | 5/1985 | Carn |
| 4,533,062 | A | | 8/1985 | Krautkramer |
| 4,584,802 | A | | 4/1986 | Casselman et al. |
| 4,651,894 | A | | 3/1987 | Ebert |
| 4,697,618 | A | | 10/1987 | Youtt et al. |
| 4,714,170 | A | | 12/1987 | Scott |
| 4,715,513 | A | * | 12/1987 | Shelton, Jr. ..... 220/4.12 X |
| 4,840,283 | A | | 6/1989 | Lillywhite et al. |
| 4,871,081 | A | | 10/1989 | Ershig |
| 4,934,553 | A | | 6/1990 | McCarthy |
| 4,960,222 | A | | 10/1990 | Fields, III |
| 4,976,912 | A | | 12/1990 | Madle et al. |
| 5,033,638 | A | | 7/1991 | Cruver et al. |
| 5,060,815 | A | | 10/1991 | Wendling et al. |
| 5,161,690 | A | | 11/1992 | Foshaug |
| 5,165,569 | A | | 11/1992 | Furuhashi et al. |
| 5,201,432 | A | | 4/1993 | Elvin-Jensen |
| 5,201,435 | A | | 4/1993 | Harding et al. |
| 5,285,922 | A | | 2/1994 | Harding |
| 5,287,986 | A | | 2/1994 | Frost |
| 5,333,752 | A | * | 8/1994 | Harding, Jr. ..... 220/565 |
| 5,374,026 | A | | 12/1994 | Spurrier et al. |
| 5,430,927 | A | | 7/1995 | Rogers |

* cited by examiner

*Primary Examiner*—Steven Pollard
(74) *Attorney, Agent, or Firm*—Hovey Williams LLP

(57) ABSTRACT

A containment tank assembly is provided which includes an inner tank, and an outer vessel with a containment area therebetween. Discharge from the inner tank is provided through a discharge outlet preferably located adjacent the bottom wall of the inner tank, the discharge outlet extending through the outer vessel. Anchor assemblies are provided to tie down the roof of the inner tank and to abut the outside of the outer vessel. The outer vessel is preferably configured with substantially flat, vertical chord sections which are tangential to the cylindrical sidewall of the lower section of the inner tank. The inner tank is preferably provided with chutes which fit into notches along the upper margin of the outer vessel to permit liquid to flow from an internal trough back into the lower section of the inner tank and to resist relative rotational movement between the inner tank and the outer vessel.

24 Claims, 4 Drawing Sheets

CONTAINMENT TANK ASSEMBLY

BACKGROUND OF THE INVENTION

1. Field of the Invention

This invention concerns a containment tank assembly providing an inner tank which nests within an outer containment vessel designed to avoid spills due to leakage of liquid stored therein. The containment tank assembly is capable of use in environments subject to high winds and seismic disturbances, while providing ease of discharging and filling.

2. Description of the Prior Art

Storage of liquid in bulk is well known, and has evolved in importance due to environmental concerns over the escape of chemicals. In the past, it was common to store chemicals underground in large tanks where gravity was used to fill the vessels and the contents were periodically pumped for use. However, the problems associated with leaking underground storage tanks has increased the usage of above ground storage tanks. Typically, one or more above-ground vessels have been placed in a "tank farm" where a concrete pad and berm help to contain and capture any leakage. However, even in these circumstances, leakage from a tank has proved a problem. Rainwater received in the containment area must be monitored and treated if leakage is detected. This has proven very expensive, as the rainwater represents a large volume of liquid even though the leakage is isolated.

As a result, storage containers have been developed which include a double walled construction. Examples of containment tanks utilizing such construction are shown in U.S. Pat. Nos. 5,287,986 to Frost and U.S. Pat. No. 5,333,752 to Harding, Jr. While the double walled construction therein is an improvement over single walled tanks, they require filling and discharge to be accomplished from atop the tanks. This requires extra energy to be expended in pumping the liquid. Moreover, the construction of such tanks is not adapted for utilization in areas where high winds and seismic disturbances may cause violent shifting or sloshing of the contents. Thus, there has developed a need for a containment tank assembly which is capable of use in a variety of environments, minimizes, leakage, and has reduced energy demands.

SUMMARY OF THE INVENTION

These objects have largely been met by the containment tank assembly of the present invention. That is to say, the containment tank assembly hereof not only improves resistance to leakage, but permits the contents of the tank assembly to be discharged by gravity. Furthermore, the tank assembly hereof is highly stable even when filled to capacity, and thus resistant to turnover and consequent leakage during seismic events. The containment assembly includes an inner tank and an outer vessel which are formed separately and which nest together, permitting expansion and contraction of the tank and vessel in both vertical and horizontal dimensions independently of one another, thereby reducing the likelihood of fatigue or fracture due to stress.

Broadly speaking, the containment tank assembly hereof includes an inner tank which is configured to nest within an outer containment vessel. A discharge outlet is provided with a sealing boot, whereby liquid within the inner tank may be discharged through the outer containment vessel without leakage therein. The inner tank includes lugs at circumferentially spaced intervals around the upper edge which may receive tie-die cables for securement of the tank assembly to anchors on the pad or other supporting surface. The inner tank has a sidewall which includes an upper section and a lower section and a connecting drain lip. The lip includes at least one and preferably a plurality of chutes which are received in corresponding notches in the outer vessel. This both provides additional structural support for the inner tank, locate the inner tank in proper alignment with the outer vessel, and allow liquid collected within the lip of inner tank to drain down into the central cylindrical section for discharge from the inner tank. This not only aids in preventing spillage, but also helps to ensure that all of the useful contents of the inner tank may be used rather than wasted.

The inner tank has a preferably cylindrical lower section and an enlarged. upper section with a roof thereover, preferably continuously formed by rotational molding. The roof serves a cover over the inner tank and extends radially outwardly of the uppermost portion of the containment vessel, aiding in shedding rainwater and thus avoiding the intrusion of liquid between the inner tank and outer vessel. The lower section and upper section are connected by the lip as noted above. Advantageously, the outer vessel is molded with an open upper edge with one or a plurality of notches therein. The outer vessel is uniquely configured with a substantially cylindrical upper wall continuous with a lower wall having a plurality of chord sections and arcuate sections when viewed in plan. The chord sections are sized and configured to tangentially engage the outer surface of the lower section of the inner tank in a plurality of engagement areas, thereby enhancing the seismic and wind resistance performance of the assembly without the need for additional spacer blocks or other protrusions between the outer vessel and the inner tank. As a result, the inner tank is further restrained against movement relative to the outer vessel and the molding of the outer vessel may be facilitated.

The containment tank assembly hereof facilitates the use of optional accessories such as a leak detection system. A probe may be placed between the inner tank and the outer vessel with an indicator visible from outside the outer vessel. If no liquid is collected in the containment area therebetween, then rainwater may be permitted to runoff without treatment as there is an affirmative indication that no leakage has occurred. A level indicator and fill pipe assembly advantageously utilizes the double wall construction to permit filling of the inner tank from the side of the assembly rather than from the roof. Additionally, in especially cold environments, insulation or heater elements may be placed between the inner tank and outer vessel to provide indirect heating of the liquid contents of the inner tank.

These and other advantages will be readily appreciated by those skilled in the art with reference to the detailed description and drawings which follow.

DESCRIPTION OF THE PREFERRED EMBODIMENT

Figure 1:
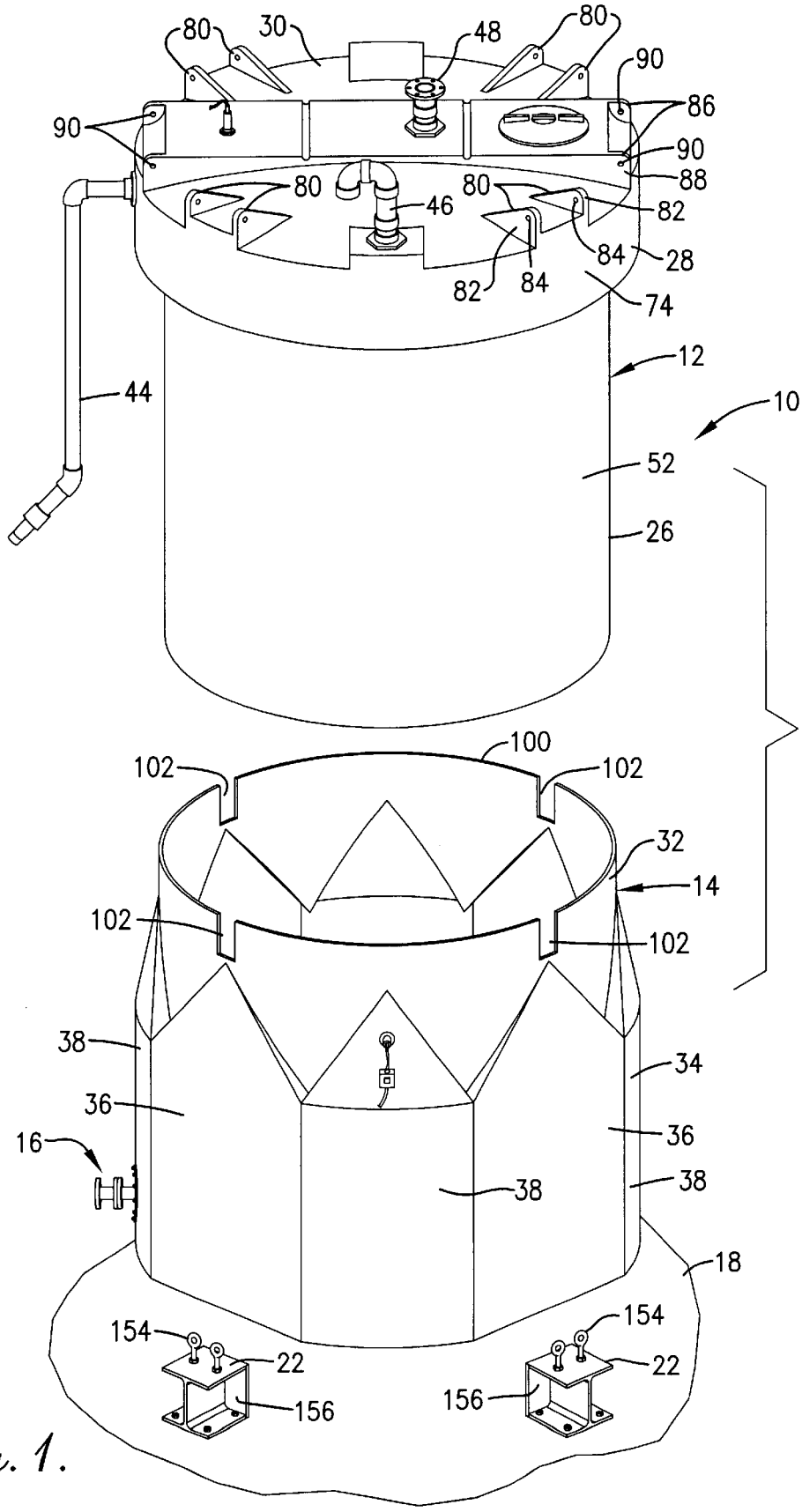
FIG. 1 is an exploded view of the containment tank assembly showing the inner tank and outer vessel separated and a transition fitting of the outlet.
Figure 5:
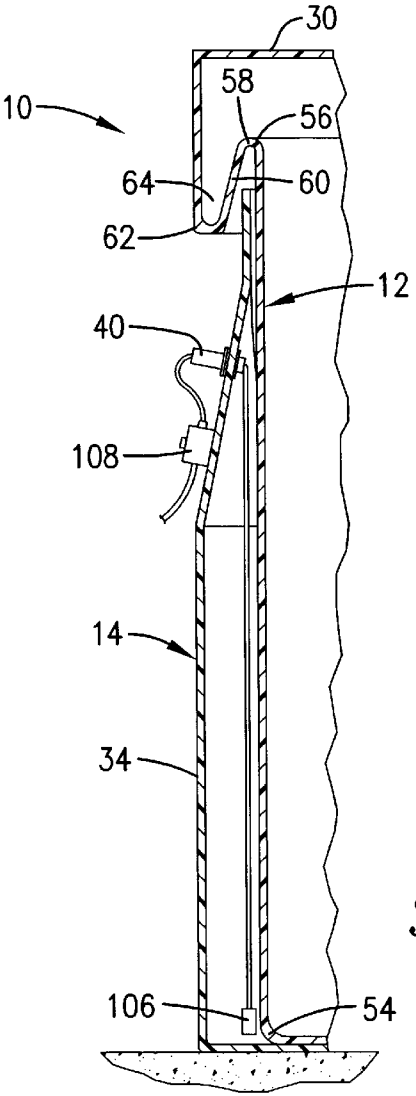
FIG. 5 is a vertical sectional view taken along line 5—5 of FIG. 3, showing the containment area and the spaced relationship between the vessel and the tank in the arcuate sections of the vessel lower wall.
Figure 2:
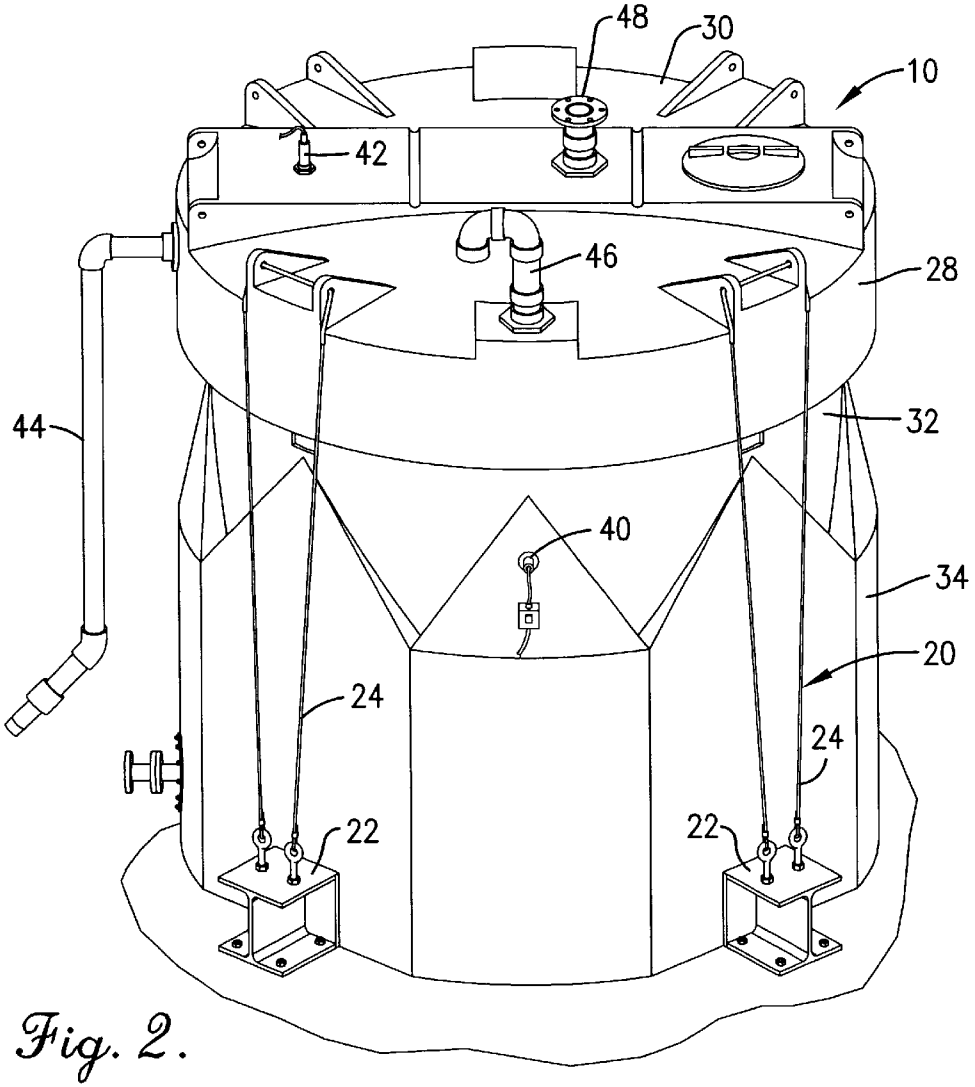
FIG. 2 is a perspective view of the containment tank assembly hereof.
Figure 3:
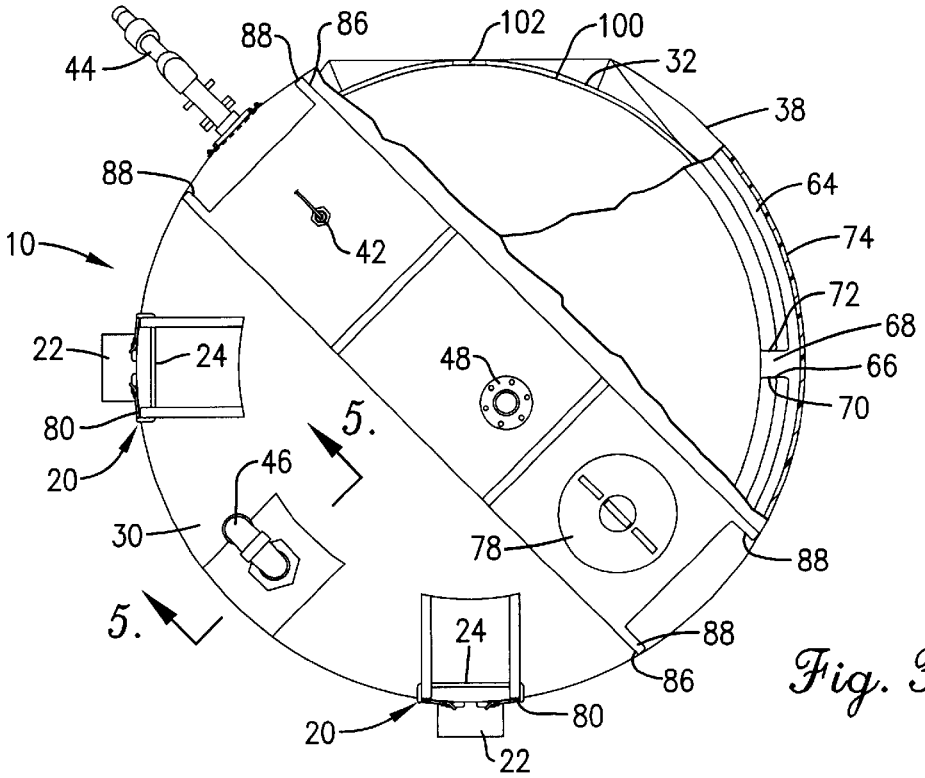
FIG. 3 is a top plan view of the containment tank assembly with a portion of both the roof and a portion of the containment vessel broken away to show the chutes of the inner tank.

Referring now to the drawing, a containment tank assembly 10 broadly includes an inner tank 12 received in nesting relationship in an outer vessel 14, and a discharge outlet 16. The discharge outlet 16 preferably is positioned near the bottom of the inner tank 12 to permit drainage of liquid received therein. The containment tank assembly 10 rests on a pad 18 or other supporting surface and may be secured thereto by anchor assembly 20, which includes anchors 22 and cables 24. As seen in FIGS. 1 and 2, the inner tank includes a lower section 26, a radially outwardly extending upper section 28, and roof 30 which serves as a cover over the assembly 10. The outer vessel 14 includes a cylindrical upper wall 32 and a multifaceted lower wall 34 including chord sections 36 and arcuate sections 38. The assembly 10 may also optionally include a leak detection system 40, an inner tank fluid level detector 42, a fill pipe 44, a vent 46 and a top filler inlet 48. The details of the structure of the discharge outlet 16 are further described in my U.S. Patent Application entitled Discharge Outlet for Double Walled Containment Tank Assembly filed contemporaneously herewith as application Ser. No. 09/519,326 filed Mar. 6, 2000, and further identified by attorney docket number 27769, the disclosure of which is incorporated herein by reference.

In greater detail, inner tank 12 has a substantially flat, circular bottom wall 50 which is integrally molded with an upright cylindrical sidewall 52 to provide lower section 26. The upright sidewall 52 extends between lower perimeter 54 and upper perimeter 56, where a bend 58 turns downwardly and outwardly along inclined surface 60 to provide lip 62. The lip 62 includes a circumferentially extending circular trough 64 which receives overflow liquid therein. The lip 62 includes four circumferentially spaced U-shaped chutes 66 which fluidically connect the trough 64 with the interior of lower section 26 for returning liquid received in trough 64 back to the lower section. The U-shaped chutes 66 are each formed with a substantially horizontal sole plate 68 and two spaced apart side plates 70 and 72. The upper section 28 has a circular, upright band wall 74 which is located radially outward from the sidewall 52 of the lower section. Band wall 74 may include a hole therein to permit connection of fill pipe 44 to introduce liquid therethrough. Roof 30 substantially encloses the inner tank 12 to provide a chamber 76 therein. The roof 30 includes holes for attachment of a level indicator 42, vent 46 and filler inlet 48. A larger opening is provided for receiving an interfitting manhole cover 78 for permitting access into the chamber 76. Arranged at circumferentially spaced intervals generally over the chutes 66 are tie-down flange pairs 80, each pair 80 including spaced and opposed ears 82 having a hole 84 for receiving cables 24 therethrough as shown in FIG. 2. In addition, diametrically positioned lifting flange pairs 86 extend upwardly from the roof 30, each flange 88 of the pair having a hole 90 capable of receiving a cable therethrough, whereby the inner tank 12 may be lifted out of nesting relationship with outer vessel 14. Both the ears 82 of tie-down flange pairs 80 and the flanges 88 of lifting flange pairs are configured for receiving a pin as well as a cable therethrough, and can be used for the attachment of additional equipment platforms or ladders to the roof. The inner tank 12 is preferably rotationally molded of high density linear polyethylene or cross-linked high density linear polyethylene.

Figure 6:
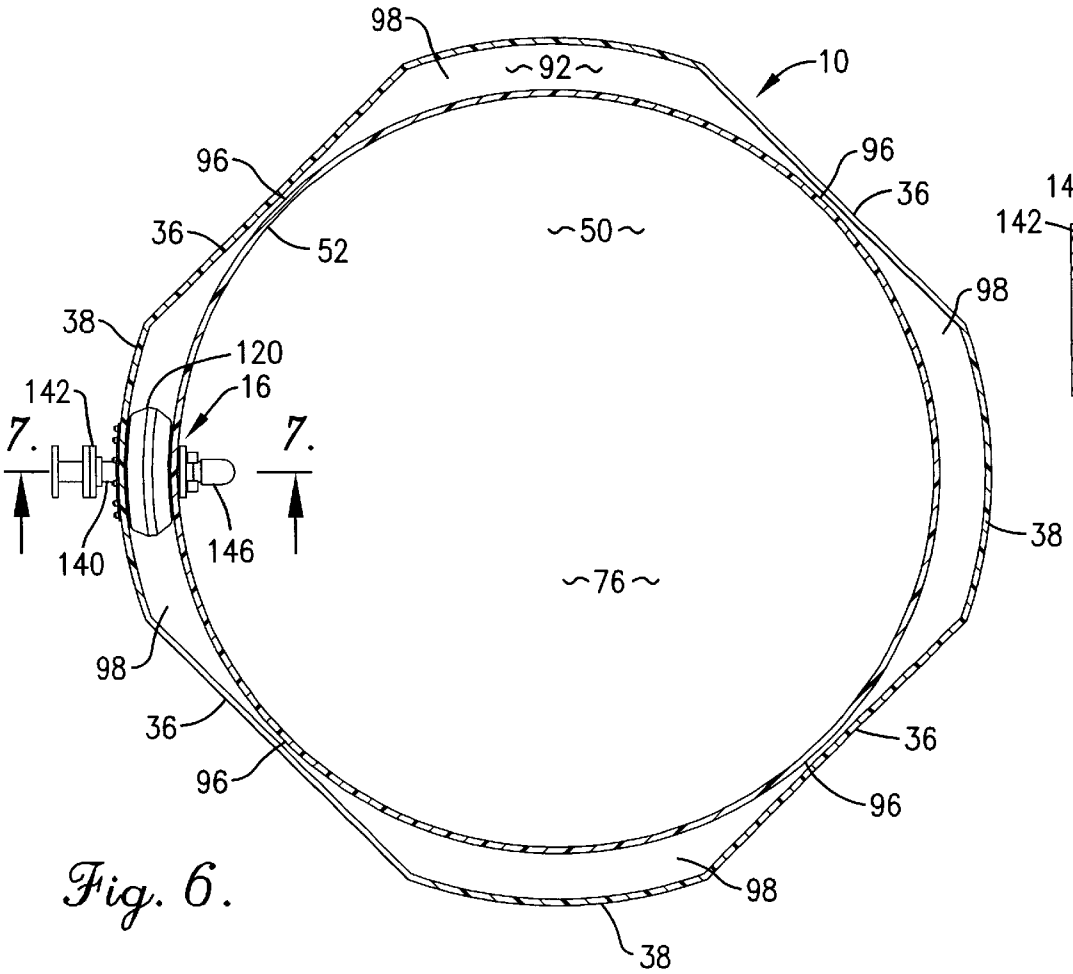
FIG. 6 is a horizontal cross-sectional view taken through the outer vessel and inner tank to show the containment area therebetween and the tangential orientation of chordal sections in the multifaceted lower wall of the outer vessel in relation to the cylindrical sidewall of the lower section of the inner tank.

Outer vessel 14 includes a base wall 92 which is normally substantially horizontal and bottom wall 50 rests thereon. The base wall 92 is continuous with containment wall 94 which extends upwardly forming multifaceted lower wall 34 and then transitions to substantially cylindrical upper wall 32. The multifaceted lower wall 34 presents four arcuate sections 38 which alternate with substantially flat sided chord sections 36. As seen in FIG. 6, the chord sections are oriented to be substantially tangential to the upright cylindrical sidewall 52 of lower section 26 of inner tank 12, and are closely proximate so that when the inner tank 12 expands during filling with liquid into the chamber 76, the sidewall 52 expands into engagement with the chord sections 36 along an upright area of engagement 96 there between extending substantially the entire vertical height of the outer vessel 14, but leaving a containment area98 between the containment wall 94 and the sidewall 52 circumferentially between areas of engagement 96 and especially in the area of the arcuate sections 38. The areas of engagement 96 are thus substantially vertical, with the diameter of the containment wall at the areas of engagement (the middle of the chordal sections) being the same as the diameter of the cylindrical upper wall 38. The portion of the containment wall 94 in the cylindrical upper wall portion has an upper margin 100 which is open to receive the inner tank 12 therein. Four rectangular notches 102 are circumferentially spaced and sized to receive the U-shaped chutes 66 therein, the lower edge 104 of the notches being low enough so that the sole plate of the chutes 66 preferably does not rest thereon. Thus, the weight of the inner tank 12 is borne by the base wall of the outer vessel, not the containment wall 94. The outer vessel 14 is preferably rotationally molded of synthetic resin, such as high density linear polyethylene or cross-linked, high-density polyethylene. The containment wall 94 may be provided with a leak detection sensor 40 extending through the containment wall 94 and sealed against leakage. The leak detection sensor 40 is preferably positioned in an arcuate section 38, and has a probe 106 extending down into the containment area 98 adjacent the base wall 92, and an indicator 108 which visually signals the presence of liquid in the containment area.

The sidewall 52 and containment wall 94 each include respective openings 110 and 112 which are in registry when the inner tank 12 is properly inserted into the outer vessel 14. As shown in FIG. 6, the discharge outlet 16 permits discharge of liquid from the inner tank 12 therethrough, and is connected to the inner tank 12 at opening 110 and to containment vessel 14 at opening 112. The discharge outlet 16 includes an inner flange 114 positioned within the chamber 76, an inner gasket 116, an outer gasket 118, sealing boot 120, outer flange 122, bolts 124 and nuts 126 coupled to the inner tank 12. The sealing boot 120 is preferably rotationally molded of polyethylene which provides flexibility and fluid containment, and is substantially tire-shaped to collect fluid received therein. The sealing boot 120 is connected to the outer vessel 14 by inner and outer metal flanges 128 and 130, and further sealed by gaskets 132 and 134, with bolts 136 and nuts 138 provided to secure the sealing boot 120 to the containment wall 94. The inner flange 128 is preferably provided as two semi-annular flange halves. A conduit or discharge tube 140 extends outwardly from the outer flange 122 to a connection flange 142 for attachment of a valve to close the opening thereby provided and control the discharge. Any type of valve, such as a ball valve, may be utilized. An inner tube 144 extends inwardly from inner flange 114 to elbow 146 which turns preferably downwardly to pipe 148 having an opening 150 adjacent to the bottom wall of the inner tank 12.

In use, the inner tank 12 is lowered into the containment tank whereby the chutes 66 are received in notches 102 with the openings 110 and 112 in registry. The discharge outlet 16 is then bolted in place, with the flexible sealing boot 120 providing the only connection therebetween. The sealing boot 120 thus catches any seepage past the flanges 114 and 122. The inner tank 12 is then filled through either fill pipe 44 or filler inlet 48 to a desired level, preferably below the lower edge 104 of notch 102. If filled above that level, liquid will spill over into trough 64, but returns into the chamber 76 interiorly of lower section 26 once sufficient liquid is drained to lower the upper surface of the liquid below the sole plate 68 of the chutes. The space between the inner tank 12 and containment vessel 14 enables the inner tank to expand during filling without causing weight to be supported on the containment wall 94. The chutes 66 and notches 102 further limit any relative rotational movement between the inner tank 12 and the outer vessel 14. The close proximity and tangential relationship of the chord sections 38 to the cylindrical sidewall 52 of the inner tank help to reinforce the inner tank 12 when the latter is filled with liquid, and help in maintaining alignment and centering of the inner tank 12 within the outer vessel 14 during transport. When filled and the discharge outlet 16 is provided with a suitable valve bolted or otherwise attached to the outside of the connection flange 142, liquid within the inner tank 12 may be drained through the tubular channel 151 defined through discharge outlet 16 until the upper surface of the liquid is below the inner tube 144, and then most of the remaining liquid may be discharged by use of a suction pump or the like. Vent 46 permits liquid to be readily drained from the inner tank 12 without the creation of a vacuum, and allows compensation for changes in air pressure.

Figure 4:
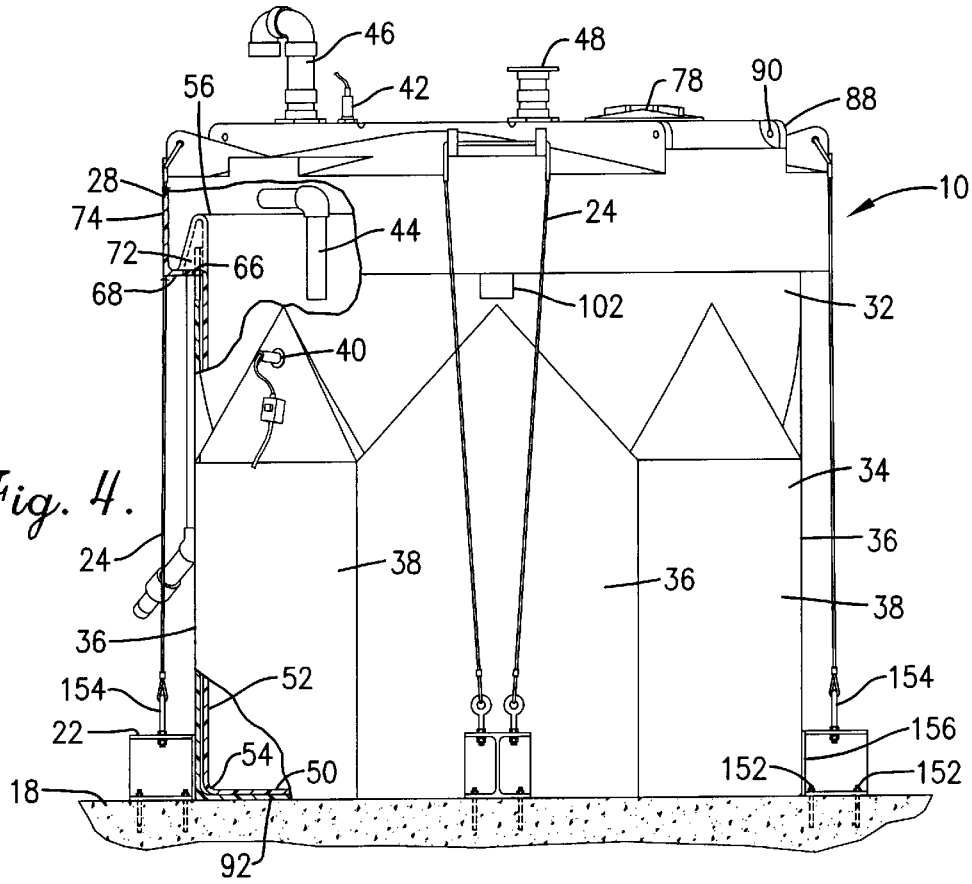
FIG. 4 is a side elevational view of the assembly hereof with portions of the tank and vessel walls shown in section to show the relatively close positioning therebetween in the chord sections of the vessel lower wall.
Figure 7:
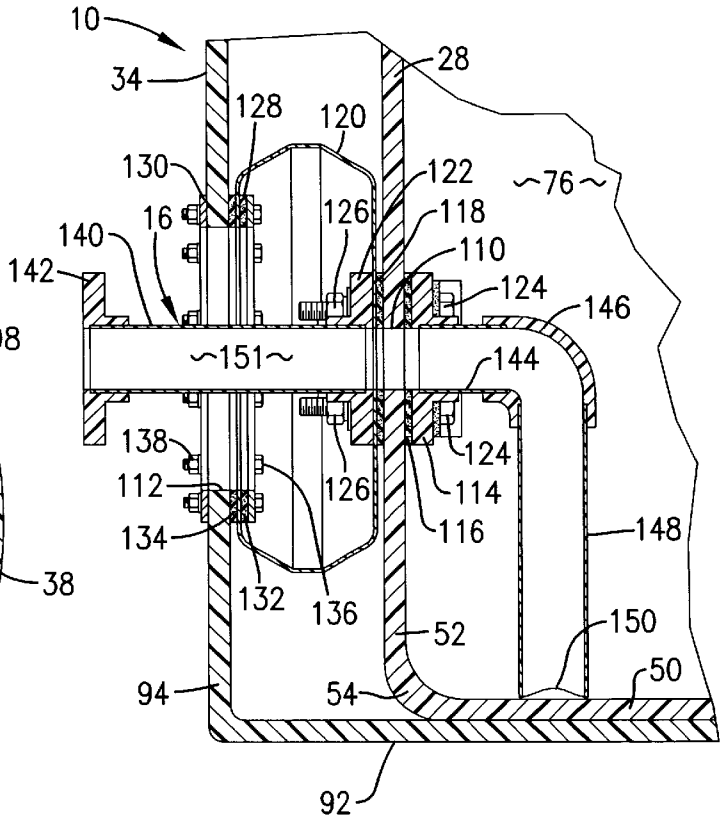
FIG. 7 is a vertical cross-sectional view taken through line 7—7 of FIG. 6 showing the discharge outlet having a sealing boot positioned in the containment area between the inner tank and outer vessel and a conduit extending from a flange connected to the inner tank exteriorly of the outer tank.

To prevent the tank from tipping, or to prevent spillage or breakage due to rapid movement of the liquid in the chamber 76 due to high winds or seismic events, the anchors 22 may be secured to the pad 18 by anchor bolts 152 as shown in FIG. 4. The anchors 22 are fabricated from sheet steel or alternatively may be forged or cast and present flanges to receive the anchor bolts 152 and eye bolts 154, the latter being secured by suitable nuts threaded thereon. The anchors 20 also include a bearing wall 156 for engaging the flat outer surface of chord sections 36. Cables 24 are routed through the holes 84 in the opposed ears 82 of the pairs of tie-down flanges and tightened, but do not contact the outer vessel 14 and thus do not rub or otherwise interfere with the containment capabilities. By placing four sets of anchor assemblies 20 at circumferentially spaced intervals, the containment tank assembly 10 is highly resistant to movement or damage and resists tip over in winds as high as 110 miles per hour. Seismic events which cause the ground, and therefor the liquid in the chamber 76 to move, have little result, as any relative shear forces are transmitted directly by the inner tank 12 to the outer vessel 14 and then prevented from further movement by the anchor assemblies 20.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his/their invention as pertains to any apparatus not materially departing from but outside the literal scope of the invention as set out in the following claims.

What is claimed is:

1. A containment tank assembly comprising:

an outer vessel having a continuous base wall and upright containment wall presenting an open upper margin;

to an inner tank concentrically received in said outer vessel in nesting relationship, said inner tank having a bottom wall, an upright sidewall and a roof defining therein an enclosed storage chamber, said inner tank sidewall and said outer vessel containment wall being configured to present a plurality of circumferentially spaced apart engagement areas in which the sidewall and the containment wall are mutually relatively spaced, each of said engagement areas extending vertically for a distance along the inner tank sidewall to maintain the inner tank centered within the outer vessel; and a discharge outlet fluidically communicating with said chamber proximate the bottom wall and extending through said containment area and said containment wall for enabling discharge of liquid from said chamber therethrough.

2. A containment tank assembly as set forth in claim 1, said discharge outlet including a sealing member for permitting relative movement between the inner tank and the outer vessel and preventing leakage of liquid received in said chamber into said containment area.

3. A containment tank assembly as set forth in claim 1, including respective openings in said sidewall and said containment wall, said discharge outlet including a tubular member defining a passage for the liquid out of the inner tank.

4. A containment tank assembly as set forth in claim 1, said inner tank having a lip extending outwardly from said sidewall, said sidewall having an upper perimeter, said lip including a trough lower than said upper perimeter, and including at least one chute for permitting liquid to flow under the influence of gravity from said trough toward said bottom wall.

5. A containment tank assembly as set forth in claim 4, wherein said roof extends outwardly of said upper perimeter of said sidewall in covering relationship to said lip.

6. A containment tank assembly as set forth in claim 5, said lip including a circumscribing upright band wall, and including a fill pipe fluidically communicating with said chamber through said band wall.

7. A containment tank assembly as set forth in claim 1, said roof including at least one attachment member having an opening therein.

8. A containment tank assembly as set forth in claim 7, further including at least one anchor coupled to a supporting surface and a tensioning member interconnecting said attachment member to said anchor.

9. A containment tank assembly as set forth in claim 8, wherein said tensioning member is a cable.

10. A containment tank assembly as set forth in claim 1, further including a plurality of anchors positioned in abutting relationship to the exterior of said outer vessel.

11. A containment tank assembly as set forth in claim 1, wherein said upright sidewall is substantially cylindrical.

12. A containment tank assembly as set forth in claim 11, wherein said containment wall of said outer vessel includes a substantially cylindrical upper wall.

13. A containment tank assembly as set forth in claim 12, wherein said substantially cylindrical upper wall of said outer vessel includes a plurality of circumferentially spaced notches therein.

14. A containment tank assembly as set forth in claim 13, wherein said inner tank includes a plurality of substantially U-shaped members extending outwardly from said sidewall complementally sized and located for receipt in said notches.

15. A containment tank assembly as set forth in claim 11, wherein said containment wall of said outer vessel includes a multifaceted lower wall.

16. A containment tank assembly as set forth in claim 15, wherein said multifaceted lower wall includes alternating arcuate sections and substantially flat, upright chordal sections.

17. A containment tank assembly as set forth in claim 16, wherein said chordal sections are substantially tangential to said cylindrical sidewall of said inner tank.

18. A containment tank assembly comprising:

an outer vessel having a continuous base wall and upright containment wall presenting an open upper margin;

an inner tank received in said outer vessel in nesting relationship, said inner tank having a bottom wall, an upright sidewall and a roof defining therein an enclosed storage chamber, said inner tank sidewall and said outer vessel wall being spaced to present a containment area therebetween; and a discharge outlet fluidically communicating with said chamber proximate the bottom wall and extending through said containment area and said containment wall for enabling discharge of liquid from said chamber therethrough, said inner tank having a lip extending outwardly from said sidewall, said sidewall having an upper perimeter, said lip including a trough lower than said upper perimeter, and including at least one chute for permitting liquid to flow under the influence of gravity from said trough toward said bottom wall.

19. A containment tank assembly as set forth in claim 18, wherein said roof extends outwardly of said upper perimeter of said sidewall in covering relationship to said lip.

20. A containment tank assembly as set forth in claim 19, said lip including a circumscribing upright band wall, and including a fill pipe fluidically communicating with said chamber through said band wall.

21. A containment tank assembly comprising:

an outer vessel having a continuous base wall and upright containment wall presenting an open upper margin;

an inner tank received in said outer vessel in nesting relationship, said inner tank having a bottom wall, an upright sidewall and a roof defining therein an enclosed storage chamber, said inner tank sidewall and said outer vessel wall being spaced to present a containment area therebetween; and a discharge outlet fluidically communicating with said chamber proximate the bottom wall and extending through said containment area and said containment wall for enabling discharge of liquid from said chamber therethrough, wherein said containment wall of said outer vessel includes a substantially cylindrical upper wall having a plurality of circumferentially spaced notches therein and wherein said inner tank includes a plurality of substantially U-shaped members extending outwardly from said sidewall complementally sized and located for receipt in said notches.

22. A containment tank assembly comprising:

an outer vessel having a continuous base wall and upright containment wall presenting an open upper margin; and an inner tank received in said outer vessel in nesting relationship, said inner tank having a bottom wall, an upright sidewall, a lip projecting outwardly and downwardly from an upper bend in said sidewall and including a trough having a band wall extending upwardly therefrom, and a roof defining therebeneath an enclosed storage chamber, said inner tank sidewall and said outer vessel containment wall being spaced along at least a portion of the containment wall to present a containment area therebetween, the upper margin of the containment wall extending above the lowermost portion of the trough and in vertically spaced relationship to the upper bend to permit expansion and contraction of the tank and the vessel.

23. A containment tank assembly comprising:

an outer vessel having a continuous base wall and upright containment wall presenting an open upper margin, said upright containment wall including a multifaceted lower wall and a substantially cylindrical upper wall;

an inner tank received in said outer vessel in centered, substantially concentric nesting relationship, said inner tank having a bottom wall, an upright sidewall and a roof defining therein an enclosed storage chamber, said inner tank sidewall and said multifaceted lower wall of said outer vessel wall having a plurality of areas of engagement therebetween and a plurality of spaced containment areas therebetween; and a discharge outlet fluidically communicating with said chamber proximate the bottom wall and extending through said containment area and said containment wall for enabling discharge of liquid from said chamber therethrough.

24. A containment tank assembly as set forth in claim 23, wherein said substantially cylindrical upper wall has a diameter which is substantially the same as a diameter of said areas of engagement.

* * * * *